US005529003A

United States Patent [19]

Kojima et al.

[11] Patent Number: 5,529,003

[45] Date of Patent: Jun. 25, 1996

[54] ROLLED HEM SWITCHING DEVICE FOR OVERLOCK MACHINE

[75] Inventors: Shinji Kojima; Norio Tezuka, both of Utsunomiya, Japan

[73] Assignee: The Singer Company N.V., Curaco, Netherlands

[21] Appl. No.: 346,649

[22] Filed: Nov. 30, 1994

[30] Foreign Application Priority Data

Dec. 20, 1993 [JP] Japan ..... 5-072829 U

[51] Int. Cl.[6] ..... D05B 1/14; D05B 37/04

[52] U.S. Cl. ..... 112/168

[58] Field of Search ..... 112/168, 162, 112/141, 143, 122, 129, 126

[56] References Cited

U.S. PATENT DOCUMENTS

| | | | |
|---|---|---|---|
| 4,970,976 | 11/1990 | Kitai et al. | 112/168 X |
| 5,216,970 | 6/1993 | Sakuma | 112/168 |
| 5,255,622 | 10/1993 | Baba et al. | 112/168 X |

*Primary Examiner*—Peter Nerbun
*Attorney, Agent, or Firm*—McCormick, Paulding & Huber

[57] ABSTRACT

A rolled hem switching device comprises a lower knife mounting base which is arranged below a throat plate and is adjustably movable in a lateral direction by way of a laterally moving mechanism provided on a sewing machine frame, a moving pawl which slidably engages a guide groove extending in a cloth feeding direction on a side surface of the lower knife mounting base, a presser member which is fixed to the lower knife mounting base and slidably supports a side surface of the moving pawl and which comprises a horizontal slit of a given length for projecting a projecting portion of the moving pawl therethrough and a lower knife which is fixed to a side surface of the lower knife mounting base at a front side of the presser member for slidably supporting a side surface of the moving pawl. As a result, it is possible not only to switch between forming overlock stitches and forming rolled hem, but also to adjust the width of the overlock stitches by integrally adjusting the lateral positions of the moving pawl and lower knife without changing a throat plate and it is also possible to stably hold the moving pawl.

1 Claim, 2 Drawing Sheets

ROLLED HEM SWITCHING DEVICE FOR OVERLOCK MACHINE

BACKGROUND OF THE INVENTION

1. Field of the Invention

The present invention relates to a rolled hem switching device for an overlock machine.

2. Prior Art

The overlock machine forms overlock stitches by the cooperative operations of a vertically movable needle holding a needle thread, an upper looper holding an upper looper thread passed through a thread hole at the tip end portion thereof and operates across a workpiece feed direction and a lower looper holding a lower looper thread passed therethrough. The overlock machine of this kind forms two kinds of stitches, i.e., overlock stitches formed at an edge of cloth which has been cut off by upper and lower knives and is kept in a flat state and those formed at the edge of the cut cloth which is in a rolled state, i.e., rolled hem.

Conventional overlock machines, however, have to prepare exclusive throat plates respectively dedicated to the above two kinds of stitches, being accompanied by a troublesome operation of exchanging the throat plates themselves in case of switching between the overlock stitches and the rolled hem. Moreover, in case of changing the width of the overlock stitches, the overlock machines have to further prepare some kinds of throat plates corresponding thereto.

In order to partially solve such a problem, there is a rolled hem switching device for an overlock machine disclosed in Japanese Utility Model Publication No. 5-20298. This device is provided with a fixed-pin pawl extending by the side of the needle location portion of the throat plate in the cloth feeding direction and a moving pawl arranged by the side of the fixed-pin pawl, the moving pawl being retractable.

The conventional rolled hem switching device, however, is capable of switching between forming the overlock stitches and forming the rolled hem by moving the moving pawl which can freely advance or retreat, but is incapable of adjusting the width of the overlock stitches since the moving pawl can only move forward or backward but cannot move to the left or right for adjustment due to its structure. The adjustment of width of overlock stitches involves an operation of exchanging the throat plate with another one.

Because it is a necessary condition of forming stitches of high quality for an overlock machine to properly set the distance between the needle location portion of the throat plate and the end of workpiece which has been cut off by a lower knife and a positional relationship between the end of the cut cloth and the moving pawl for catching the looper thread during sewing. If the lower knife alone is moved to change only the width of a workpiece without moving the moving pawl relative to the needle location portion of the throat plate for meeting the change of width of the overlock stitches, there occurs a problem such as rolling in the case of thin cloth, or producing a defective product having loose stitches. As a result, respective throat plates exclusively corresponding to some widths of the overlock stitches are required for forming stitches of high quality.

Moreover, it is difficult for the rolled hem switching device in the conventional overlock machine to stably hold the moving pawl which is provided under the throat plate and moves forward or backward. That is, the moving pawl mounted on the lower surface of the throat plate by a set spring which elastically presses the former against the latter from below advances forward during forming the overlock stitches so that the tip end portion of the moving pawl goes away from the position of the set spring. As a result, the moving pawl is liable to be elastically moved during forming the overlock stitches, and particularly when the moving pawl has play vertically or horizontally the tension of the needle thread or looper thread becomes unstable, resulting in a defective sewn product having uneven tension in stitches or loose stitches.

SUMMARY OF THE INVENTION

The present invention has been made in view of the aforesaid technical problem in the prior art. A rolled hem switching device according to a first aspect of the invention, in an overlock machine which forms overlock stitches by the cooperative operations of a vertically movable needle holding an upper thread, an upper looper holding an upper looper thread passed through a thread hole at the tip end portion thereof and operates across a workpiece feeding direction and a lower looper holding a lower looper thread, comprises a throat plate 2 mounted on a sewing machine frame 1, a fixed-pin pawl 3 which extends in a cloth feeding direction X on the throat plate 2 and is close to a side of a needle location portion 2*a* of the throat plate 2 at the tip end portion thereof, a lower knife mounting base 7 which is arranged below the throat plate 2 and is adjustably movable in the lateral direction perpendicular to the cloth feeding direction X by way of a laterally moving mechanism 16 provided on the sewing machine frame 1, a moving pawl 5 which slidably engages a guide groove 7*a* extending horizontally in the cloth feeding direction X on a side surface of the lower knife mounting base 7 and has a tip end pawl portion 5*b* at the front end portion thereof, a presser member 9 which is fixed to the lower knife mounting base 7 and covers a side of the guide groove 7*a* to slidably support a side surface of the moving pawl 5 and which comprises a longitudinally extending slit 9*a* of a given length for projecting the projecting portion 5*a* of the moving pawl 5 therethrough and a lower knife 8 which is fixed to a side surface of the lower knife mounting base 7 at the front side of the presser member 9 with regard to the cloth feeding direction X to cover a side of the guide groove 7*a* for slidably supporting a side surface of the moving pawl 5 and which cuts an uneven side edge of a workpiece, characterized in that the rolled hem switching device switches between forming overlock stitches by advancing the moving pawl 5 by way of the projecting portion 5*a* thereof in the cloth feeding direction X to position the tip end pawl portion 5*b* thereof at a side of the needle location portion 2*a* with the fixed-pin pawl 3 intervening therebetween and forming rolled hem by retracting the moving pawl 5 to withdraw the tip end pawl portion 5*b* thereof into the throat plate 2 at a side of the needle location portion 2*a*.

The rolled hem switching device according to the first aspect of the invention switches to forming the overlock stitches by advancing the moving pawl 5 by way of the projecting portion 5*a* thereof within the gaps of given lengths between the projecting portion 5*a* and the front and rear ends of the slit 9*a* and to forming the rolled hem by moving the moving pawl 5 backward. At the time of switching between the overlock stitches and the rolled hem, the moving pawl 5 which longitudinally slidably engages the guide groove 7*a* of the lower knife mounting base 7 is slidably supported by the presser member 9 and lower knife 8 at a side surface thereof, so that the movement of the tip end pawl portion 5b of the moving pawl 5 is stabilized to keep the overlock stitches at a high quality, the overlock stitches being formed while the moving pawl 5 is advanced in the cloth feeding direction X.

Moreover, the projecting portion 5a of the moving pawl 5 which projects through the slit 9a of the presser member 9 is supported by the presser member 9 at the front and rear sides thereof, so that the moving pawl 5 is restrained from bending or deformation due to the manipulation of the projecting portion 5a to keep the overlock stitches, which are formed while the moving pawl 5 is advanced in the cloth feeding direction X, at a high quality. When sewing is performed by retracting the moving pawl 5 to withdraw the same into the throat plate 2 and positioning the fixed-pin pawl 3 alone thereon at a side of the needle location portion 2a, rolled hem is formed at a side edge of the workpiece which has been evenly cut by the lower knife 8 and an upper knife.

When the width of the overlock stitches is changed, the lower knife mounting base 7 is moved for adjustment in the lateral direction perpendicular to the cloth feeding direction X by way of the laterally moving mechanism 16 provided on the sewing machine frame 1. As a result, the moving pawl 5 and the lower knife 8 are laterally moved together to increase or decrease the distance between the needle location portion 2a of the throat plate 2 and the tip end pawl portion 5b of the moving pawl 5 without substantially varying the relative relationship in position between the lower knife 8 and the moving pawl 5. As described above, it is possible to properly set the width of overlock stitches by adjusting the position of the overlock stitches of the workpiece and the cutting position of the cloth by the lower knife 8 without exchanging the throat plate 2.

PREFERRED EMBODIMENT OF THE INVENTION

An embodiment of the invention will be described with reference to drawings.

Figure 1:
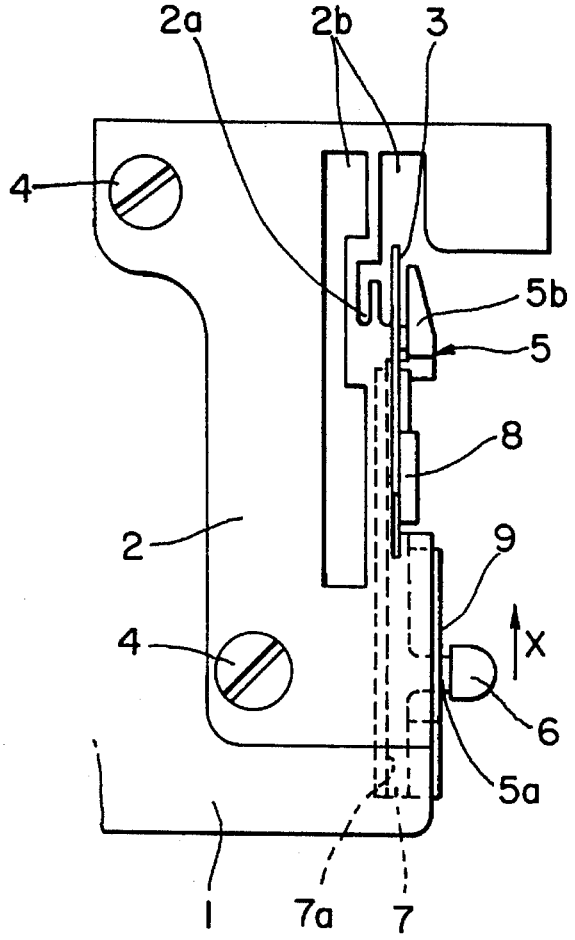
FIG. 1 is a plan view of a rolled hem switching device for an overlock machine according to an embodiment of the invention.

FIGS. 1 to 4 show a rolled hem switching device for an overlock machine according to an embodiment of the invention. In FIG. 1, denoted at 1 is a sewing machine frame of the overlock machine, to which a throat plate 2 is detachably attached by a plurality of set screws 4. The throat plate 2 comprises a needle location portion 2a and a feed dog hole 2b, through which a feed dog, not shown, for feeding a workpiece in the cloth feeding direction (indicated by an arrow X in FIG. 1), comes out and in. Denoted at 3 is a fixed-pin pawl, which extends in the cloth feeding direction (X) close to a side of the needle location portion 2a of the throat plate 2 at the tapered tip end portion thereof and is fixed to the throat plate 2 at the base end portion thereof.

Figure 3:
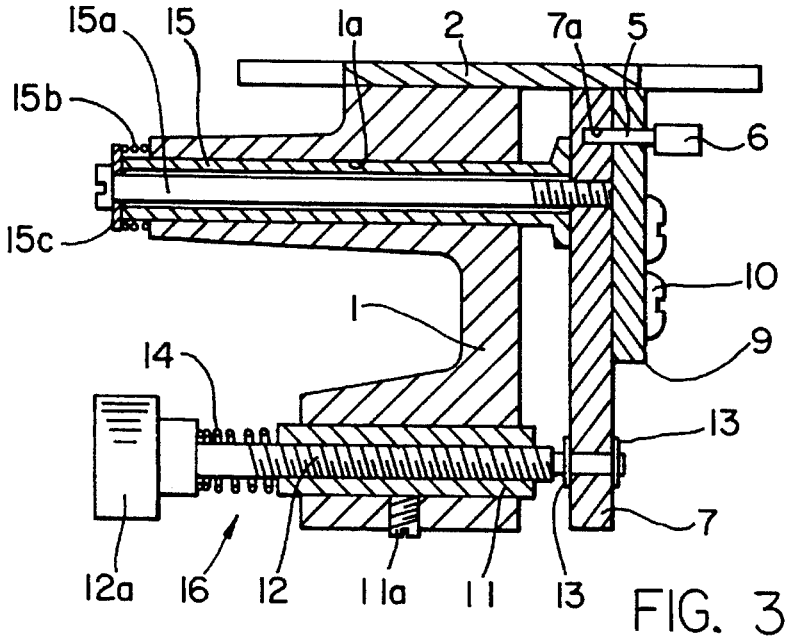
FIG. 3 is a cross-sectional view of the rolled hem switching device taken along a line III—III in FIG. 2.

Under the throat plate 2, a lower knife mounting base 7 is disposed at the rear side of the needle location portion 2a with regard to the cloth feeding direction (X). The lower knife mounting base 7 is mounted on the sewing machine frame 1 in such a way as to be freely adjustable in the lateral direction perpendicular to the cloth feeding direction (X). That is, as illustrated in FIG. 3, a set screw 15a is inserted through a washer 15c into a guide sleeve 15 which fits in the upper guide hole 1a of the sewing machine frame 1 from the reverse side of the sewing machine frame 1 relative to the lower knife mounting base 7 to be screwed thereinto at the tip end portion thereof so as to clamp the guide sleeve 15 between the lower knife mounting base 7 and the washer 15c, thereby supporting the upper portion of the lower knife mounting base 7 to be movable left and right relative to the sewing machine frame 1. Moreover, the upper portion of the lower knife mounting base 7 is elastically forced outside by a spring 15b compressedly inserted between the washer 15c and the sewing machine frame 1.

On the other hand, the lower portion of the lower knife mounting base 7 is supported by a threaded shaft 12 which is rotatably fixed to the lower portion of the lower knife mounting base 7 at the non-threaded tip end portion thereof, the lower portion of the lower knife mounting base 7 being clamped by a pair of stop rings 13 fit onto the non-threaded tip end portion of the threaded shaft 12, and which engages the internally threaded bush 11 forced into the sewing machine frame 1 and fixed thereto by a set screw 11a. The threaded shaft 12 is provided with a knob portion 12a at the base end portion thereof and a spring 14 compressedly inserted between the knob portion 12a and the end surface of the internally threaded bush 11 for absorbing backlash between the threaded shaft 12 and the internally threaded bush 11 so as to be rattle-free. The guide sleeve 15 and threaded shaft 12 fixed to the lower knife mounting base 7, the internally threaded bush 11 fixed to the sewing machine frame 1, etc. constitute the laterally moving mechanism 16 which is provided on the sewing machine frame 1 for adjustably moving the lower knife mounting base 7 in the lateral direction perpendicular to the cloth feeding direction X.

Figure 4:
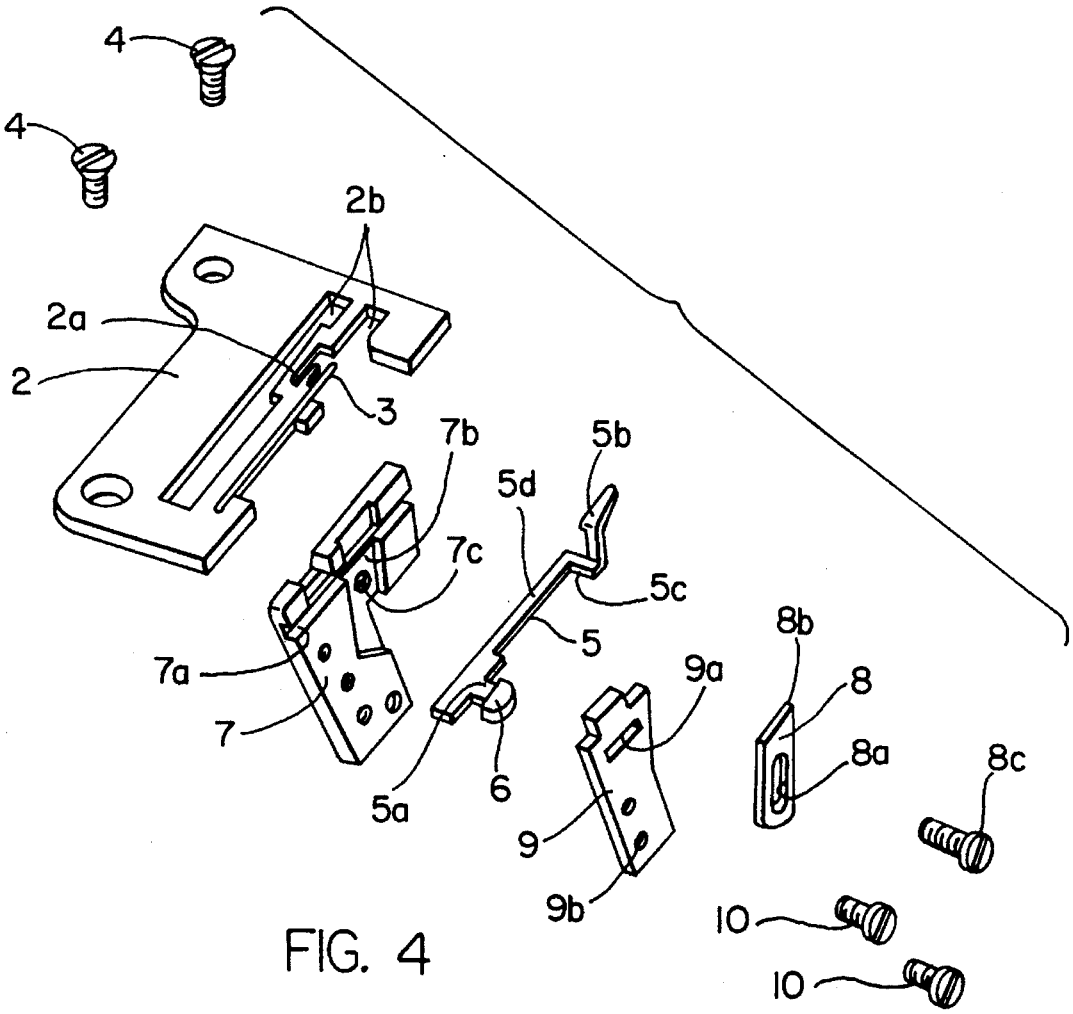
FIG. 4 is an exploded perspective view of the rolled hem switching device in FIG. 1.

A horizontal guide groove 7a is formed on a side surface of the upper end portion of the lower knife mounting base 7 set forth above as illustrated in FIG. 4. The guide groove 7a extends close to the needle location portion 2a at the state in which the lower knife mounting base 7 is mounted on the sewing machine frame 1 as illustrated in FIG. 1. The moving pawl 5 has a sliding portion 5d horizontally extending at the base end side thereof, which engages the guide groove 7a to be slidable longitudinally therein and is slidably supported at a side surface thereof by a presser member 9 which is fixed to a side surface of the lower knife mounting base 7 by screws 10 to cover a side of the guide groove 7a. A horizontal slit 9a having a given length is formed in the presser member 9 at the portion corresponding to the guide groove 7a and the projecting portion 5a of the moving pawl 5 projects through the slit 9a leaving given gaps at the front and rear ends of the slit 9a. A knob 6 is fixed to the tip end of the projecting portion 5a.

Since the moving pawl 5 tightly engages the horizontal guide groove 7a at the sliding portion 5d having a rectangular cross section and is slidably supported at a side surface of the sliding portion 5d thereof by the presser member 9 which covers a side of the guide groove 7a, the moving pawl 5 can slide along the guide groove 7a without backlash and play. Moreover, it is also possible to adjust the range of forward and backward movement of the projecting portion 5a by forming the through holes 9b of the presser member 9 through which the screws 10 are inserted as longitudinally long holes to thereby adjust the longitudinal position of the presser member 9 and consequently that of the slit 9a.

Figure 2:
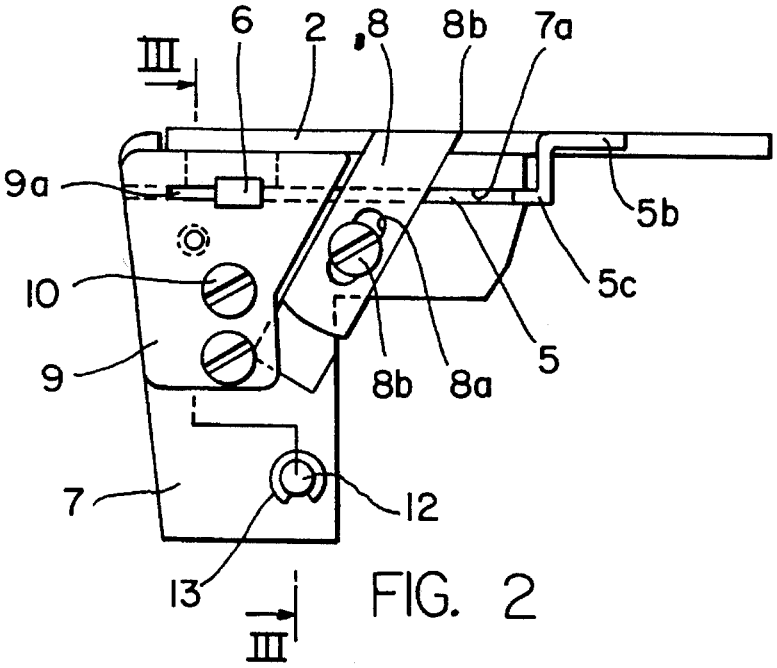
FIG. 2 is a side view of the rolled hem switching device in FIG. 1.

A tip end pawl portion 5b is formed at the front end side of the moving pawl 5, the tip end pawl portion 5b extending forward horizontally from a protruding portion 5c which projects outside from the tip end of the sliding portion 5d and then upward to form a shape of L. The tip end pawl portion 5b is gradually tapered in the cloth feeding direction (X) and the upper surface thereof conforms in height to that of the throat plate 2 so as to place the workpiece thereon as illustrated in FIG. 2.

Moreover, a lower knife mounting groove 7b which extends vertically intersecting with the guide groove 7a is formed on a side surface of the lower knife mounting base 7 at the front side of the presser member 9 with respect to the cloth feeding direction (X). A lower knife 8 is fixed to the lower knife mounting groove 7b to be vertically adjustable in position by screwing a set screw 8c into a threaded hole 7c of the lower knife mounting base 7 through a vertically long hole 8a of the lower knife 8. The lower knife 8 has functions of cutting irregular edges of the workpiece cooperating with the upper knife, not shown, so as to trim the side edge thereof, as well as slidably supporting a side surface of the moving pawl 5 by covering a side of the guide groove 7a. Whereas the moving pawl 5 slides forward or backward along the guide groove 7a until the front or rear ends of the projecting portion 5a thereof is brought into contact with the rear or front end surface of the slit 9a respectively while being supported by the presser member 9 and lower knife 8 at a side surface of the sliding portion 5d thereof by moving the knob 6 forward or backward. The protruding portion 5c of the moving pawl 5 is located ahead of the front end portion 8b of the lower knife 8 even when the moving pawl 5 is moved backward.

The function of the rolled hem switching device according to the embodiment of the invention will be described hereinafter.

Switching operation between the overlock stitches and the rolled hem is performed by advancing the moving pawl 5 in the cloth feeding direction (X) and retracting the same respectively by way of the knob 6 of the projecting portion 5a. At the time of switching between the overlock stitches and the rolled hem, the moving pawl 5, which engages the guide groove 7a of the lower knife mounting base 7 to be freely slidable forward and backward, is stable at the tip end pawl portion 5b thereof partially because the moving pawl 5 is slidably supported by the presser member 9 and lower knife 8 at a side surface of the sliding portion 5d thereof, so that the overlock stitches which are formed by advancing the moving pawl 5 in the cloth feeding direction (X) are kept high in quality.

Furthermore, the moving pawl 5 is supported by the presser member 9 at the front and rear sides of the projecting portion 5a which projects through the slit 9a of the presser member 9 to prevent the moving pawl 5 from bending or deformation due to the manipulation of the projecting portion 5a, so that the overlock stitches which are formed by advancing the moving pawl 5 in the cloth feeding direction (X) are kept high in quality. When sewing is performed by retracting the moving pawl 5 to withdraw the same into the throat plate 2 and positioning the fixed-pin pawl 3 alone thereon at a side of the needle location portion 2a, a rolled hem is formed while a side edge of the workpiece which has been evenly cut by the lower knife 8 and an upper knife is fed in a state wherein it stretches out sideways from the fixed-pin pawl 3 and is rolled inside along the periphery of the fixed-pin pawl 3 due to the thread tension in sewing.

Next, in case of changing the width of the overlock stitches, the threaded shaft 12 is turned normally or reversely by way of the knob portion 12a to move the threaded shaft 12 laterally relative to the sewing machine frame 1 while elastically deforming the spring 14 or move the guide sleeve 15 laterally relative to the sewing machine frame 1 while elastically deforming the spring 15b so as to adjust the lateral position of the lower knife mounting base 7. As a result, the moving pawl 5 and the lower knife 8 are laterally moved together to increase or decrease the distance between the needle location portion 2a of the throat plate 2 and the tip end pawl portion 5b of the moving pawl 5 without substantially varying the relative relationship in position between the lower knife 8 and the moving pawl 5. In this way it is possible to properly set the width of the overlock stitches by adjusting the position of the overlock stitches and the cutting position of the workpiece by the lower knife 8 without exchanging the throat plate 2.

As understood from the above description, the rolled hem switching device of the invention not only can switch between forming the overlock stitches and forming the rolled hem by moving the moving pawl forward and backward, but also can adjust the width of the overlock stitches formed at an edge of cut cloth as it is kept in a flat state by integrally adjusting the lateral positions of the moving pawl and lower knife without exchanging the throat plate. Accordingly, it is possible to properly set the distance between the needle location portion of the throat plate and the end of workpiece which has been cut off by a lower knife and a positional relationship between the end of the cut cloth and the moving pawl for catching the looper thread during the sewing operation of an overlock machine so as to obtain stitches of high quality. As a result, producing a defective sewn product which includes, for example, enfoldment of cloth in case the cloth is thin, or loose stitches is prevented.

Moreover, since the moving pawl is stably supported by the lower knife mounting base, the tension of the needle thread or looper thread is stabilized in forming the overlock stitches, so that the problem of producing a defective sewn product having stitches irregular in tension or loose stitches is solved.

What is claimed is:

1. A rolled hem switching device in an overlock machine which forms overlock stitches by the cooperative operations of a vertically moveable needle holding an upper thread, an upper looper holding an upper looper thread passed through a thread hole at the tip end portion thereof and operating across a workpiece feeding direction and a lower looper holding a lower looper thread comprises:

a throat plate mounted on a sewing machine frame;

a fixed-pin pawl which extends in a cloth feeding direction on said throat plate and being close to a side of a needle location portion of said throat plate at the tip end portion thereof;

a lower knife mounting base which is arranged below said throat plate and is adjustably movable in a lateral direction perpendicular to said cloth feeding direction by way of a laterally moving mechanism provided on said sewing machine frame;

a moving pawl which slidably engages a guide groove extending horizontally in said cloth feeding direction on a side surface of said lower knife mounting base and has a tip end pawl portion at the front end portion thereof;

a presser member which is fixed to said lower knife mounting base and covers a side of said guide groove to slidably support a side surface of said moving pawl and which comprises a longitudinally extending slit of a given length for receiving a projecting portion of said moving pawl therethrough; and a lower knife which is fixed to a side surface of said lower knife mounting base at a front side of said presser member with regard to said cloth feeding direction to cover a side of said guide groove for slidably supporting a side surface of said moving pawl and which cuts an uneven side edge of a workpiece characterized in that said rolled hem switching device switched between forming overlock stitches by advancing said moving pawl by way of said projecting portion thereof in said cloth feeding direction to position said tip end pawl portion thereof at a side of said needing location portion with said fixed-pin pawl intervening therebetween and forming a rolled hem by retracting said moving pawl to withdraw said tip end pawl portion thereof into said throat plate at a side of said needle location portion.

* * * * *

UNITED STATES PATENT AND TRADEMARK OFFICE

CERTIFICATE OF CORRECTION

PATENT NO. : 5,529,003

DATED : June 25, 1996

INVENTOR(S) : Shinji Kojima and Norio Tezuka

It is certified that error appears in the above-indentified patent and that said Letters Patent is hereby corrected as shown below:

On title page, item [73]

Assignee:

delete "Netherlands" and substitute --Netherlands Antilles--.

Signed and Sealed this

Twenty-fifth Day of February, 1997

*Attest:*

*Attesting Officer*

BRUCE LEHMAN

*Commissioner of Patents and Trademarks*